US006504466B1

(12) United States Patent
Katsurada

(10) Patent No.: US 6,504,466 B1
(45) Date of Patent: Jan. 7, 2003

(54) LAMINATION-TYPE COIL COMPONENT AND METHOD OF PRODUCING THE SAME

(75) Inventor: Hisashi Katsurada, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/609,340

(22) Filed: Jul. 6, 2000

(30) Foreign Application Priority Data

Jul. 5, 1999 (JP) ..... 11-190046
May 9, 2000 (JP) ..... 2000-135794

(51) Int. Cl.[7] ..... H01F 5/00
(52) U.S. Cl. ..... 336/200; 336/83; 336/232; 29/602.1
(58) Field of Search ..... 336/200, 83, 183, 336/232; 29/602.1, 831, 840, 851

(56) References Cited

U.S. PATENT DOCUMENTS 5,515,022 A 5/1996 Tashiro et al. ..... 336/200
6,189,200 B1 * 2/2001 Takeuchi et al. ..... 29/602.1

FOREIGN PATENT DOCUMENTS

JP 10-92643 * 4/1998
JP 10-163018 * 6/1998
JP 11-154618 * 6/1999

OTHER PUBLICATIONS

Patent Abstract of Japanese 4–354109 (Dec. 8, 1992).
Patent Abstract of Japanese 5–144651 (Jun. 11, 1993).

* cited by examiner

*Primary Examiner*—Lincoln Donovan
*Assistant Examiner*—Tuyen Nguyen
(74) *Attorney, Agent, or Firm*—Keating & Bennett, LLP

(57) ABSTRACT

An electrode material for formation of a coil is applied in an area including a via-hole, whereby a coil pattern is formed with the electrode material being filled into the via-hole. A magnetic material layer having a thickness T2 that is less than the thickness T1 of the coil pattern is arranged so as to surround the coil pattern. A plurality of magnetic green sheets each having the coil pattern and the magnetic material layer provided thereon are laminated and press-bonded. Thus, a laminate is formed in which in the area where the via-hole is provided, the sum Ta of the thickness T3 of the electrode material in the via-hole and the thickness T1 of the coil pattern is greater than the sum Tb of the thickness T4 of the magnetic green sheet and the thickness T2 of the magnetic material layer.

10 Claims, 8 Drawing Sheets

LAMINATION-TYPE COIL COMPONENT AND METHOD OF PRODUCING THE SAME

BACKGROUND OF THE INVENTION

1. Field of the Invention

The present invention relates to a coil component such as an inductor or other coil component, and a method of producing the same, and more particularly, the present invention relates to a lamination-type coil component including a lamination-type coil included in an element such as a lamination-type inductor, and a method of producing the same.

2. Description of the Related Art

A lamination-type inductor is a typical lamination-type coil component. For example, as shown in FIGS. 6A and 6B, the lamination-type inductor has a structure in which a lamination type coil 52 (FIG. 6B) including a plurality of internal conductors defining coil patterns 52*a* (FIG. 6B) connected together is disposed in an element in the form of a chip element 51, and moreover, external electrodes 53*a* and 53*b* (FIG. 6A) are arranged so as to be connected to both ends of the coil 52, respectively.

Such a lamination type inductor is produced, for example, by laminating a plurality of magnetic green sheets 54, each having a coil pattern 52*a* provided on the surface thereof, via a printing method, laminating magnetic green sheets (sheets defining outer layers) 54*a* each having no pattern provided thereon to the upper portion and the lower portion of the stack of laminated magnetic green sheets 54, press-bonding the sheets, connecting the respective coil patterns 52*a* through via-holes 55 to define a coil 52, as shown in FIG. 6B, firing the laminate (an unfired body), providing conductive paste on both end portions of the body 51, and firing to form external electrodes 53*a* and 53*b* (FIG. 6A).

In the conventional lamination-type inductor as shown in FIG. 7, the magnetic green sheets 54 each have a coil pattern 52*a* printed or provided on the surface thereof, so that the pattern 52*a* and its surrounding have a difference in height (that is, the portion of the green sheet 54 where the coil pattern 52*a* is printed is thick, while the portion thereof where no coil pattern is printed is thin). Therefore, the lamination and press-bonding of the plurality of magnetic green sheets 54 cannot be evenly pressed to be bonded together. Thus, in the conventional lamination-type inductor, the electrical characteristics become uneven, delamination occurs, and further problems arise. Further, an air layer may be formed between layers. This causes the problem that distributed capacitances are produced between the respective coil patterns 52*a* of the layers, due to the air layers, and the initial electrical characteristics and those after repeated use become different. Therefore, the electrical characteristics are unstable.

To solve the problems discussed above, a method of producing a lamination-type inductor has been proposed (Japanese Examined Patent Application Publication No. 7-123091), in which an auxiliary magnetic layer 56 is provided around the coil pattern 52*a* printed on the surface of each magnetic green sheet 54 in such a manner that the thickness of the auxiliary magnetic layer 56 is greater than that of the coil pattern 52*a*, after firing, as shown in FIGS. 8 and 9.

In the case of the lamination-type inductor produced by this method, a gap is formed between the coil pattern 52*a* and the magnetic layer 54 adjacent to the coil pattern 52*a* in the thickness direction (the sintered layer of the magnetic green sheet). Due to the gap 57 having a relative dielectric constant lower than that of the magnetic layer 54, the distributed capacitances are reduced, and the loss at a high frequency is decreased. Moreover, variations in the electrical characteristics, caused by repeated use, are suppressed.

However, in the case where the auxiliary magnetic layer is thicker than the coil pattern as in the above-described lamination-type inductor, the connection state of the coil patterns on the respective magnetic green sheets connected together through a via-hole becomes unstable, the stability of direct current resistance is insufficient, and the reliability is deteriorated.

SUMMARY OF THE INVENTION

To overcome the problems described above, preferred embodiments of the present invention provide a method of producing a lamination-type coil component in which coil patterns provided on each of magnetic green sheets are securely connected to each other through via-holes to form a coil pattern, the direct current resistance is very low, and the stability is excellent with high reliability.

According to a first preferred embodiment of the present invention, a method of producing a lamination type coil component includes the steps of applying an electrode material for formation of a coil to a magnetic green sheet having a via-hole formed therein in an area including the via-hole, arranging the electrode material into a predetermined pattern whereby a coil pattern is formed with the electrode material being filled into the via-hole, providing a magnetic material layer having a thickness which is less than the coil pattern so as to surround the coil pattern, laminating a plurality of magnetic green sheets having the coil pattern and the magnetic material layer provided thereon, whereby a laminate having a coil provided inside thereof is formed, press-bonding the laminate, and heat treating the press-bonded laminate.

By applying an electrode material to form a coil on a magnetic green sheet having a via-hole provided therein in an area including the via-hole, into a predetermined pattern, whereby a coil pattern is formed with the electrode material being filled into the via-hole, arranging a magnetic material layer having a thickness which is less than the coil pattern so as to surround the coil pattern, plural magnetic green sheets containing the magnetic green sheets each having the coil pattern and the magnetic material layer formed thereon are laminated, and the laminate is press-bonded, the thickness of the electrode material in the area where the via-hole is formed as viewed in the plan view is thicker than the magnetic material layer in an area surrounding the magnetic material layer. Thereby, in the press-bonding step, a sufficient pressure is applied to the electrode material constituting the coil pattern and the electrode material in the via-hole. Thus, the coil patterns formed on the respective magnetic green sheets can be securely connected through the via-hole. A lamination-type coil component having very low direct current resistance, excellent stability, and very high reliability is achieved.

In the present invention, the statement that "the magnetic material layer having a thickness which is less than the coil pattern is formed in an area surrounding the coil pattern" means that the sum of the thickness of the electrode material in the via-hole and the thickness of the electrode material constituting the coil pattern is greater than the sum of the thickness of the magnetic green sheet and the thickness of the magnetic material layer in an area surrounding the electrode materials. Accordingly, in the method of producing a lamination type coil component according to preferred embodiments of the present invention, the sum of the thickness of the electrode material in the via-hole and the thickness of the electrode material constituting the coil pattern is greater than the sum of the thickness of the magnetic green sheet and the thickness of the magnetic material layer in the area surrounding the electrode materials.

As a result, in the press-bonding step, the electrode material constituting the coil pattern and the electrode material in the via-hole is sufficiently pressed, and the coil patterns provided on the respective magnetic green sheets are securely connected to each other through the via-hole.

The coil pattern and the magnetic material layer can be formed by different methods. As an example, screen printing, plating, photolithography, or other suitable methods can be used.

Preferably, at least one of the thicknesses of the coil pattern and the magnetic material layer provided on each magnetic green sheet and the thickness-reduction ratios of the coil pattern and the magnetic material layer in the press-bonding step are controlled. Thereby, after the press-bonding, the sum of the thickness of the electrode material in the via-hole and the thickness of the coil pattern is greater than the sum of the thickness of the magnetic green sheet and the thickness of the magnetic material layer.

By controlling at least one of the thicknesses of the coil pattern and the magnetic material layer provided on the magnetic green sheet and the thickness-reduction ratios of the coil pattern and the magnetic material layer in the press-bonding step, the sum of the thickness of the electrode material in the via-hole and the thickness of the coil pattern are preferably greater than the sum of the thickness of the magnetic green sheet and the thickness of the magnetic material layer after the press-bonding. The respective coil patterns are securely connected to each other through the via-hole. Thus, a lamination-type coil component having very low direct current resistance, excellent stability, and very high reliability is achieved.

More specifically, at least one of the shrinkage ratio of the coil pattern provided on the magnetic green sheet in the heat treatment step, and the shrinkage ratio of the magnetic material layer arranged so as to surround the coil pattern is controlled. Thereby the sum of the thickness of the electrode material in the via-hole and the thickness of the coil pattern is greater than the sum of the thickness of the magnetic green sheet and the thickness of the magnetic material layer after sintering.

By controlling at least one of the shrinkage ratio of the electrode material (containing the electrode material filled in the via-hole) constituting the pattern provided on the magnetic green sheet in the heat treatment step (sintering process), and the shrinkage ratio of the magnetic material layer arranged so as to surround the coil pattern (the electrode material layer) in the heat treatment step (sintering process), the sum of the thickness of the electrode material in the via-hole and the thickness of the coil pattern after the sintering is greater than the thickness of the sintered magnetic body obtained by sintering the magnetic green sheet and the magnetic material layer. The respective coil patterns are securely connected to each other through the via-hole. A lamination-type coil component having very low direct current resistance, excellent stability, and very high reliability is achieved.

Still more specifically, the lamination-type coil component may be an inductor or other electronic component.

The present invention can be applied to methods of producing components provided with different types of lamination-type coils. By utilizing the present invention as a method of producing an inductor, a lamination-type inductor having a high reliability is efficiently produced.

According to a second preferred embodiment of the present invention, a lamination-type coil component is provided in which a lamination-type coil is arranged in a sintered magnetic body, which includes magnetic layers each having a coil conductor provided on a sintered magnetic layer and a sintered magnetic material layer arranged so as to surround the coil conductor, the coil conductors being connected to each other through the electrode material in via-holes, the sum of the thickness of the electrode material in the via-holes and the thickness of the coil conductor is greater than the sum of the sintered magnetic layer and the sintered magnetic material layer.

By setting the sum of the thickness of the electrode material in the via-holes and the thickness of the coil conductor to be greater than the sum of the sintered magnetic layer and the sintered magnetic material layer, the respective coil conductors are securely connected to each other. A lamination-type coil component having high reliability is achieved.

The lamination-type coil component can be efficiently produced by any one of the above-described methods.

Preferably, the lamination type coil component is an inductor but may also comprise other types of electronic components.

The present invention can be applied to components provided with different lamination-type coils. By applying the present invention to an inductor, a lamination-type inductor having high reliability is provided.

Other features, characteristics, elements and advantages of the present invention will become apparent from the following description of preferred embodiments thereof with reference to the attached drawings.

BRIEF DESCRIPTION OF THE DRAWINGS

FIG. 1A is a perspective view showing how a coil pattern is provided on a magnetic green sheet, FIG. 1B is a perspective view showing how a magnetic material layer is provided so as to surround the coil pattern, and FIG. 1C is a cross-sectional view showing the essential part of the magnetic green sheet;

FIG. 5A is a perspective view of the inductor, and FIG. 5B is a cross-sectional view thereof;

FIG. 6A is a perspective view of the inductor, and FIG. 6B is an exploded perspective view showing the internal structure thereof;

DETAILED DESCRIPTION OF PREFERRED EMBODIMENTS

Figure 1A:
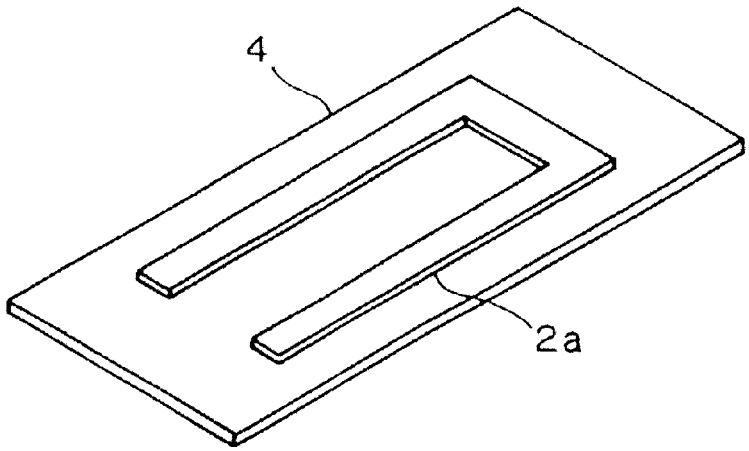
FIGS. 1A, 1B, and 1C illustrate a method of producing a lamination type coil component (lamination type inductor) according to a preferred embodiment of the present invention.

Hereinafter, features, elements, advantages and characteristics of the present invention will be described with reference to preferred embodiments of the present invention. In the following preferred embodiments, the production of a lamination-type inductor including a coil disposed in a magnetic ceramic will be described as an example.

In a first preferred embodiment of the present invention, first, materials having a weight ratio of approximately 48 mol % of $Fe_2O_3$, 28 mol % of ZnO, 16 mol % of NiO, and 8 mol % of CuO are mixed. The obtained powder is calcined at approximately 750° C. for approximately 1 hour.

The obtained calcined powder is wet-crushed for approximately 30 minutes with an attritor or other suitable implement. Then, a binder resin is added, and mixed for 1 hour.

The slurry obtained as described above is formed into a green sheet with a film thickness of approximately 80 $\mu$m or less by a doctor blade method, and cut to a predetermined size.

Then, a through-hole for a via-hole is provided at a predetermined position of the magnetic green sheet.

Then, an electrode material containing Ag as a major component is applied to a thickness of approximately 24 $\mu$m to an area containing a via-hole 5 (FIGS. 2 and 4) in the surface of a magnetic green sheet 4, for example, according to a printing technique to form a coil pattern 2*a*, as shown in FIG. 1A. Simultaneously, the electrode material 2*b* (FIG. 4) is filled into the via-hole 5.

Figure 1B:
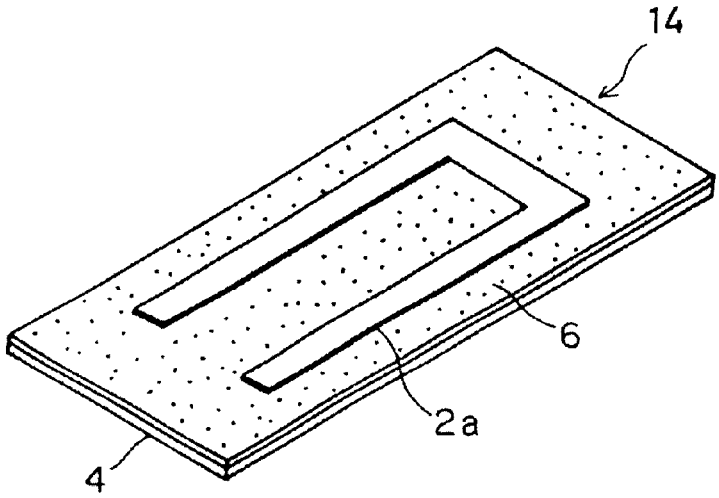
Figure 1C:
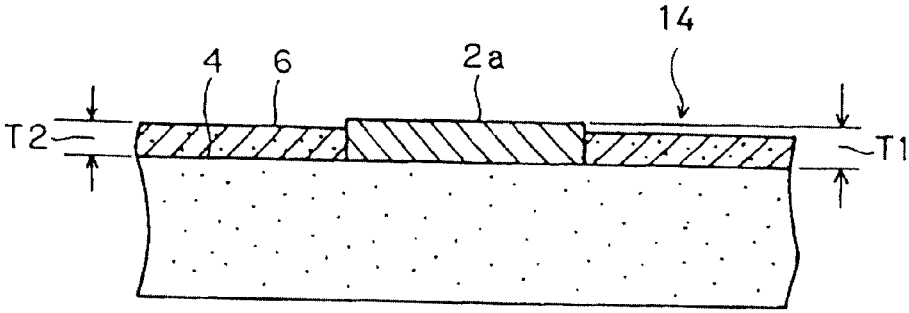
Figure 2:
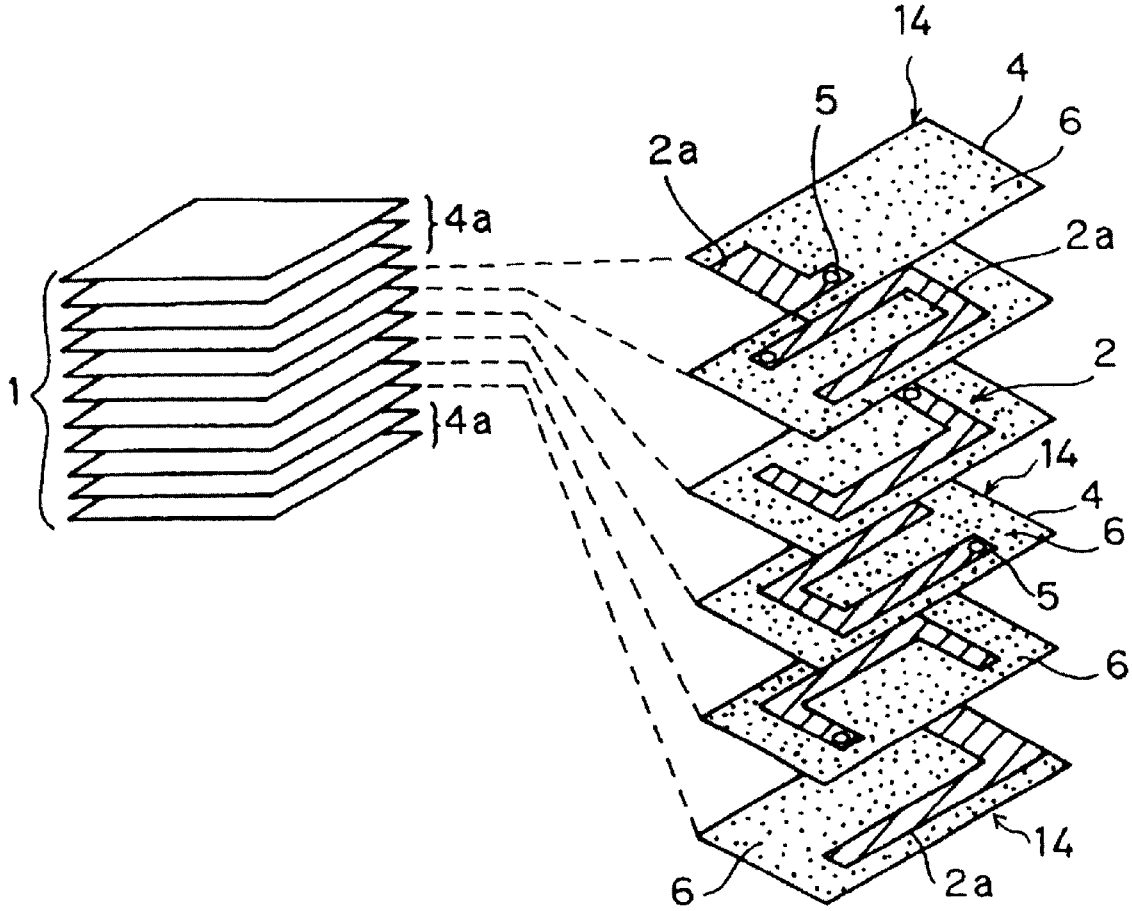
FIG. 2 illustrates one process of a method of producing a lamination type coil component according to a preferred embodiment of the present invention.

Then, a magnetic material layer 6 is formed to a thickness of approximately 18 $\mu$m so as to surround the coil pattern 2*a*, as shown in FIGS. 1B, 1C, and FIG. 2. In this case, the thickness T2 of the magnetic material layer 6 is less than the thickness T1 of the coil pattern 2*a*, as shown in FIG. 1C.

Figure 4:
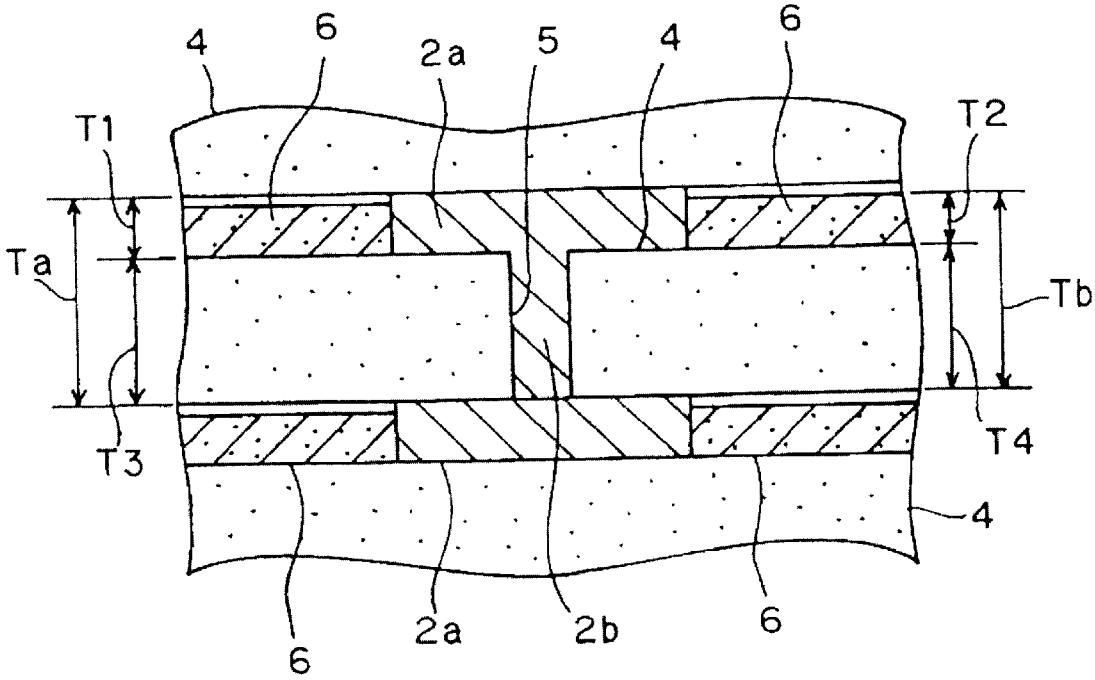
FIG. 4 is a cross-sectional view showing the structure of a via-hole and the area adjacent thereto in a laminate formed in a process of the method of producing a lamination type coil component according to a preferred embodiment of the present invention.

As a result, as shown in FIG. 4, in the area where the via-hole 5 is provided, the sum Ta of the thickness T3 of the electrode material 2*b* in the via-hole 5 and the thickness T1 of the coil pattern 2*a* is greater than the total Tb of the thickness T4 (=T3) of the magnetic green sheet 4 and the thickness T2 of the magnetic material layer 6.

Many different methods may be used to form the above-described coil pattern 2*a* and the magnetic material layer 6. For example, one method that may be used is such that an electrode material is printed a plurality of times, and thereafter, a magnetic material is applied several times to form a coil pattern and a magnetic material layer each having a predetermined thickness. Another method which may be used is such that an electrode material is printed one time, and then, a magnetic material is applied one time, and the printing of the electrode material and the application of the magnetic material are repeated to form a coil pattern and a magnetic material layer each having a predetermined thickness. Other suitable methods may also be used.

Figure 3:
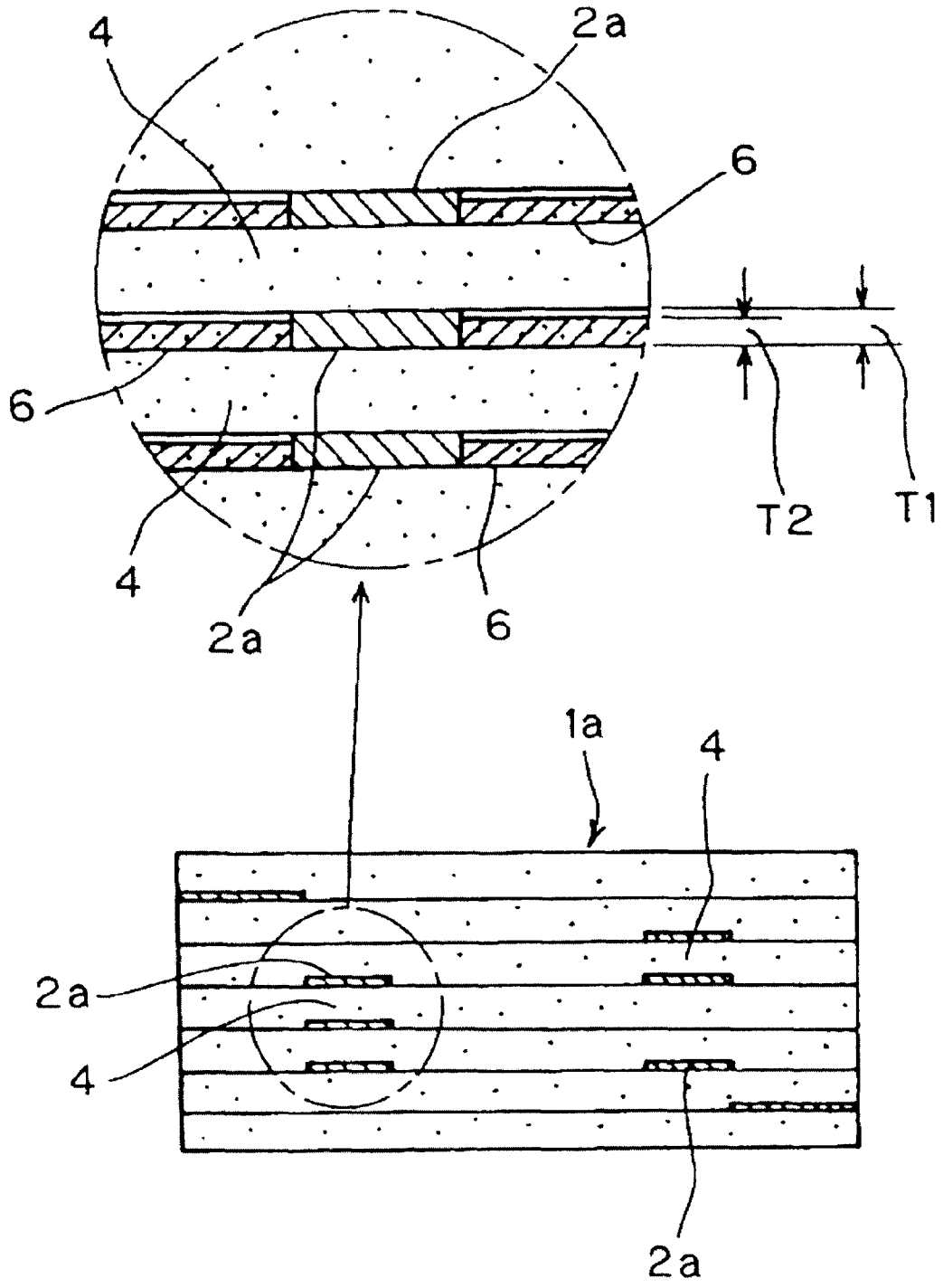
FIG. 3 is a cross-sectional view of a laminate formed in a method of producing a lamination type coil component according to a preferred embodiment of the present invention.

Next, the magnetic green sheets 4 (electrode-arranged sheets 14 as seen in FIGS. 1A, 1B, FIG. 2) each having the coil pattern 2*a* and the magnetic material layer 6 provided thereon are laminated to each other, as shown in FIGS. 2 and 3, and the coil patterns 2*a* are connected to each other through via-holes 5 to define a coil 2 (FIG. 5A, etc.), as shown in FIG. 4. On both of the upper side and the lower side of the laminated magnetic green sheets 4, magnetic green sheets (sheets for outer layers) 4*a* each having no coil pattern arranged thereon are laminated to form a laminate 1*a* (FIG. 3).

The laminate 1*a* is press-bonded at a temperature of approximately 40° C. and a pressure of approximately 1.21 t/cm$^2$ to form a press-bonded laminate. In the green laminate 1*a*, as shown in FIG. 3, the thickness T1 of each coil pattern 2*a* is greater than the thickness T2 of each magnetic material layer 6. Further, as shown in FIG. 4, in the area where the via-hole 5 is provided, the sum Ta of the thickness T3 of the electrode material 2*b* in the via-hole 5 and the thickness T1 of the coil pattern 2*a* is greater than the sum Tb of the thickness T4 of the magnetic green sheet 4 and the thickness T2 of the magnetic material layer 6. Therefore, in the press-bonding process, the coil patterns 2*a* and the electrode material 2*b* in the via-holes are securely pressed, so that the respective coil patterns 2*a* are securely connected to each other through the electrode materials 2*b* in the via-holes 5.

Where a mother magnetic green sheet is used for simultaneously producing many bodies, the green sheet described in the step of the green press-bonded laminate is divided for the respective bodies.

The press-bonded green laminate is heated at approximately 500° C. for approximately 1 hour to remove the binder, and thereafter, at an increased temperature is sintered to obtain a sintered body.

Figure 5A:
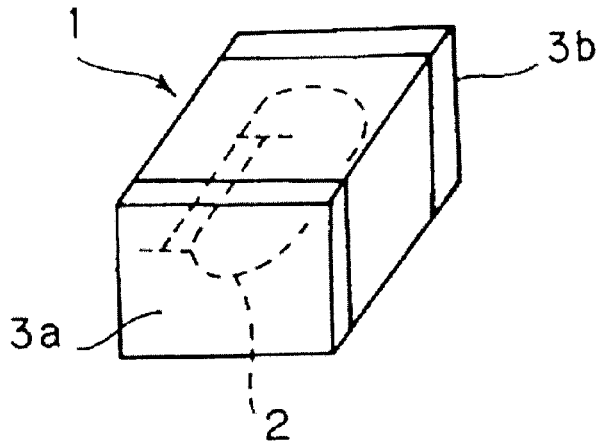
FIGS. 5A and 5B illustrate a lamination-type inductor produced by the method according to a preferred embodiment of the present invention, respectively.
Figure 5B:
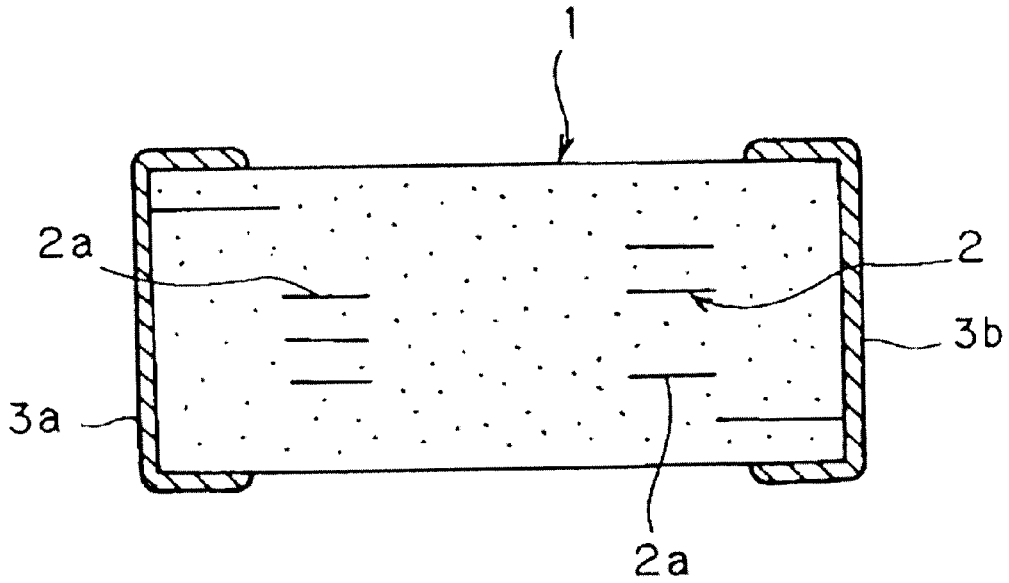
Figure 6A:
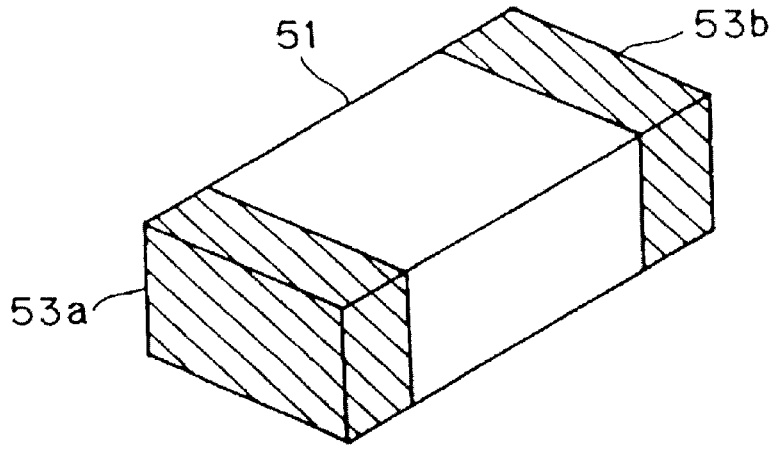
Fig.6a PRIOR ART
FIGS. 6A and 6B illustrate a conventional lamination-type inductor.
Figure 6B:
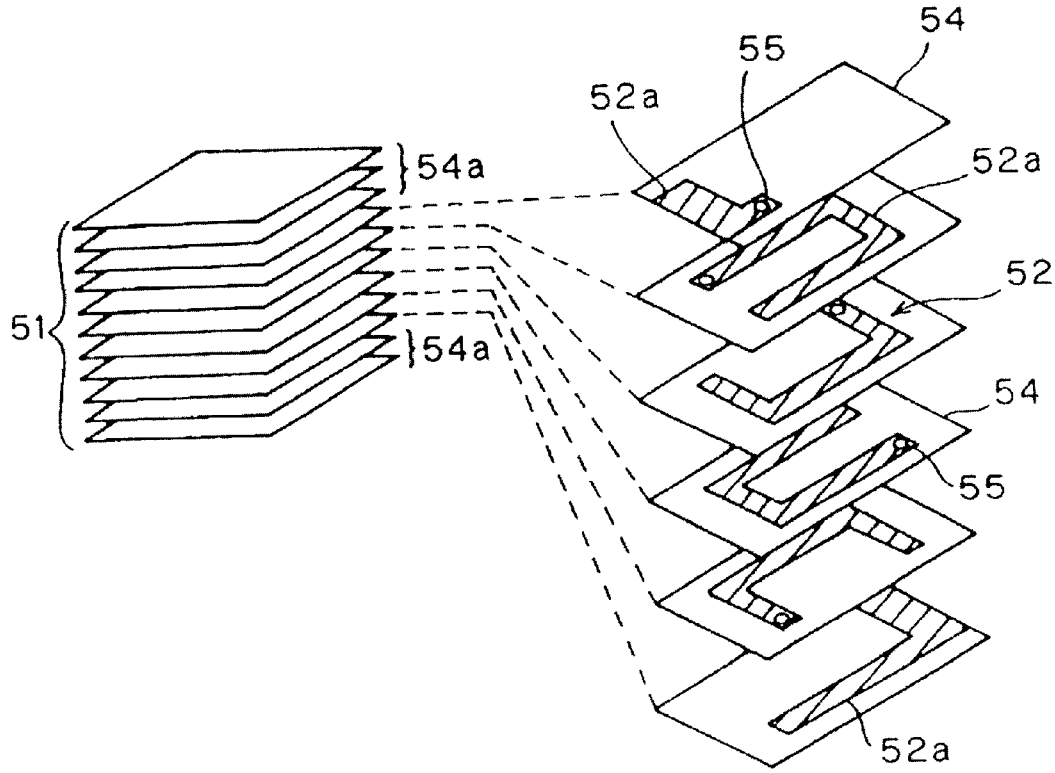
Fig.6b PRIOR ART
Figure 7:
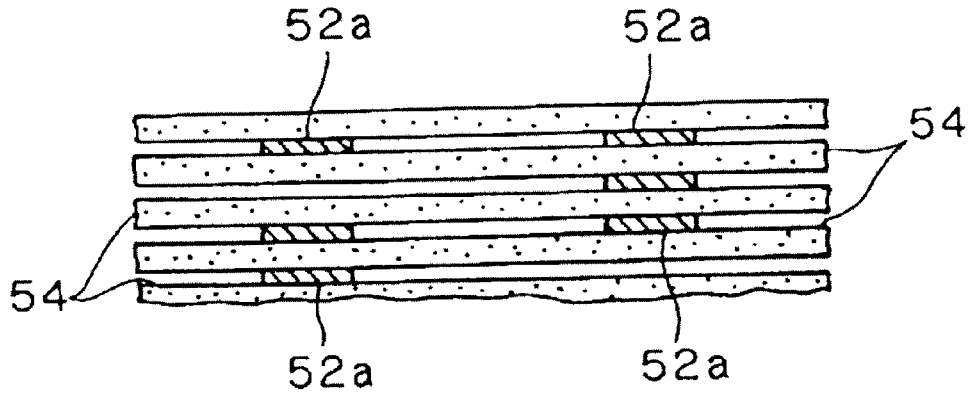
Fig.7 PRIOR ART
FIG. 7 is a cross-sectional view showing the essential part of a conventional lamination-type inductor.
Figure 8:
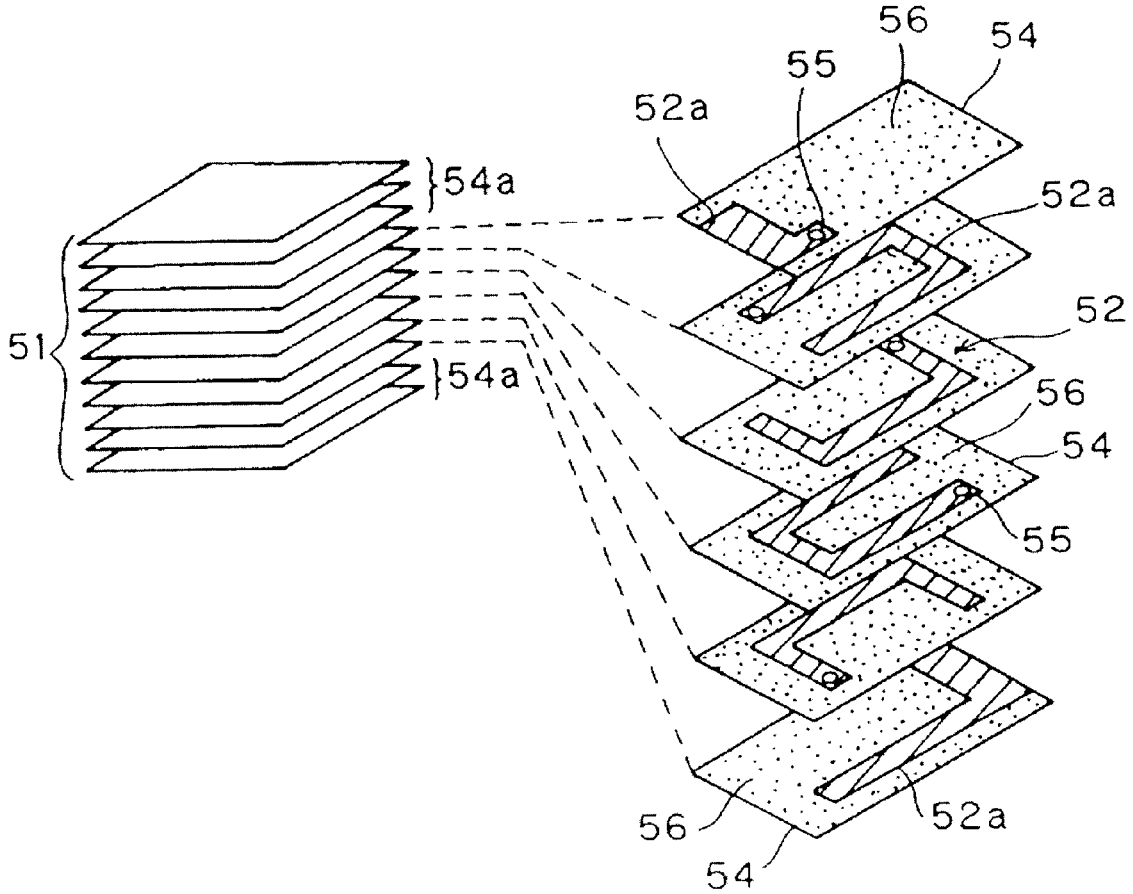
Fig.8 PRIOR ART
FIG. 8 is an exploded perspective view showing another conventional lamination-type inductor.
Figure 9:
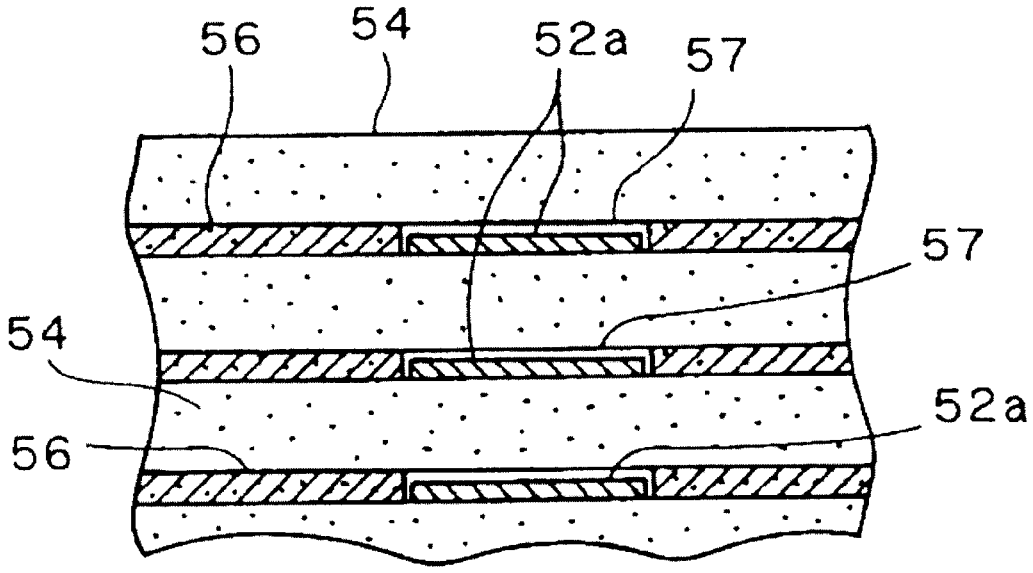
Fig.9 PRIOR ART
FIG. 9 is a perspective view showing the essential part of another conventional lamination-type inductor.

Next, electrode paste is applied on both ends of the body to be connected to the lead-out portions of the coil pattern, dried at approximately 150° C. for approximately 15 minutes, and baked, whereby a pair of external electrodes is formed. Thus, a lamination-type inductor is obtained, which has the structure in which the coil 2 is disposed in the body 1, and on the both ends of the body 1, a pair of the external electrodes 3a and 3b are disposed so as to be connected to the coil 2, as shown in FIGS. 5A and 5B.

In the method of producing a lamination-type inductor of this preferred embodiment, the coil pattern 2*a* is formed on the magnetic green sheet 4 with the magnetic material 2*b* being filled into the via-hole 5. The magnetic material layer 6 of which the thickness T2 is less than the thickness T1 of the coil pattern 2*a* is arranged so as to surround the coil pattern 2*a*. A plurality of magnetic green sheets containing the above-described magnetic green sheets are laminated and press-bonded. Thus, the electrode material (the sum Ta of the thickness T1 of the electrode material 2*a* constituting the coil pattern and the thickness T3 of the electrode material 2*b* in the via-hole 5) in the area where the via-hole 5 is formed, as viewed in the plan view, is greater than the sum Tb of the thickness T2 of the magnetic material layer 6 in the area surrounding the above electrode material and the thickness T4 of the magnetic green sheet 4. In the area where the via-hole is provided, a sufficient force is applied to the electrode materials 2*a* and 2*b* at press bonding, so that the coil patterns 2*a* formed on the respective magnetic green sheets 4 are securely connected to each other through the via-holes 5. A lamination-type coil component in which the direct current resistance is very low, the stability is excellent, and the reliability is high is achieved.

That is, in the lamination-type coil component produced by the method of the above-described preferred embodiment, conductor-arranged magnetic layers (electrode-arranged sheets 14 after sintering) each including a sintered magnetic layer (the magnetic green sheet 4 after sintering), a coil conductor (the coil pattern 2*a* after sintering) arranged on the surface of the sintered magnetic layer, and the sintered magnetic material layer (the magnetic material layer 6 after sintering) arranged so as to surround the coil conductor are laminated to each other, and the sum of the thickness of the electrode material 2*b* in the via-hole 5 and the thickness of the coil conductor (the coil pattern 2*a* after sintering) is greater than the sum of the thickness of the sintered magnetic layer (the magnetic green sheet 4 after sintering) and the thickness of the sintered magnetic material layer (the magnetic material layer 6 after sintering) is produced. Therefore, a lamination-type coil component in which the respective coil conductors are securely connected, and the reliability is high is provided.

In a second preferred embodiment of the present invention, the thickness and the thickness-reduction ratio of the electrode material defining the coil pattern and filling in the via-hole, and the thickness and the thickness-reduction ratio of the magnetic material defining the magnetic material layer (thickness after drying), are calculated. Due to the results of calculation, a laminate is formed in such a manner that the electrode material (the sum Ta of the thickness T1 of the electrode material 2*a* constituting the coil pattern and the thickness T3 of the electrode material 2*b* filled in the via-hole 5) in the area containing the via-hole 5 is greater than the sum Tb of the thickness T2 of the magnetic material layer 6 in the area surrounding the above electrode material and the thickness T4 of the magnetic green sheet 4.

The other features of the second preferred embodiment are preferably similar to that of the above-described first preferred embodiment of the present invention.

In the method of the second preferred embodiment, the thicknesses and the thickness-reduction ratios of the electrode material and the magnetic material are controlled. As a result, the thickness of the electrode material in the area where the via-hole is formed (the sum of the thickness of the electrode material constituting the coil pattern and that of the electrode material in the via-hole) is greater than the sum of the thickness of the magnetic material layer and the thickness of the magnetic green sheet in the area surrounding the above electrode material. Accordingly, the respective coil patterns are securely connected to each other through via-holes. A lamination-type coil component in which the direct current resistance is very low, and the stability is very high is achieved.

In a third preferred embodiment of the present invention, the thicknesses (after drying), the thickness-reduction ratios and the shrinkage ratios at sintering of the electrode material to be filled into the a via-hole and to define the coil pattern and the magnetic material to define the magnetic material layer are calculated. As a result, a laminate is formed in such a manner that the sum of the thickness of the electrode material filled into the via-hole and the thickness of the coil pattern after sintering is greater than the thickness of the sintered magnetic body obtained by sintering the magnetic green sheet and the magnetic material layer.

The other features of the third preferred embodiment are similar to that of the above-described first preferred embodiment of the present invention.

In the third preferred embodiment, the thicknesses, the thickness-reduction ratios and the shrinkage ratios of the materials at sintering regarding the electrode material and the magnetic material are controlled, whereby the sum of the thickness of the electrode material and the thickness of the coil pattern after sintering in the area where the via-hole is formed is greater than the thickness of the sintered magnetic body obtained by sintering the magnetic green sheet and the magnetic material layer. The respective coil patterns are securely connected to each other via via-holes. Thus, a lamination-type coil component having very low direct current resistance, excellent stability, and very high reliability is produced.

In the above-described preferred embodiments, the lamination-type inductor is described as an example. The present invention is not limited to the lamination-type inductor and may be applied to different types of lamination-type coil components including coils disposed in bodies, respectively, such as a lamination-type LC combined component or other suitable lamination-type coil component.

In other respects, the present invention is not limited to the above-described preferred embodiments. The shape and size of the coil pattern and the number of turns of the coil may be applied and changed in different ways without departing from the sprit and scope of the present invention.

As described above, in the method of producing a lamination-type coil component according to the first preferred embodiment of the present invention, an electrode material for formation of a coil is applied to a magnetic green sheet having a via-hole provided therein in an area including the via-hole, into a predetermined pattern, whereby a coil pattern is formed with the electrode material being filled into the via-hole, a magnetic material layer having a thickness which is less than the coil pattern is arranged so as to surround the coil pattern, a plurality of magnetic green sheets each having the coil pattern and the magnetic material layer formed thereon are laminated, and press-bonded to each other. Accordingly, the thickness of the electrode material in the area where the via-hole is provided is greater than the thickness of the magnetic material layer surrounding the electrode material layer, and thereby, in the press-bonding step, a sufficient pressure is applied to the electrode material constituting the coil pattern and the electrode material present in the via-hole. Thus, the coil patterns formed on the respective magnetic green sheets are securely connected through the via-hole. A lamination- type coil component having very low direct current resistance, excellent stability, and very high reliability is produced.

The thicknesses of the coil pattern and the magnetic material layer formed on the magnetic green sheet, and at least one of the thickness-reduction ratios of the coil pattern (including the electrode material filled in the via-hole) and the magnetic material layer in the press-bonding step is controlled. Therefore, the sum of the thickness of the electrode material in the via-hole and the thickness of the coil pattern is greater than the sum of the thickness of the magnetic green sheet and the magnetic material layer, and the respective coil patterns are securely connected to each other through the via-hole. A lamination-type coil component having very low direct current resistance, excellent stability, and very high reliability is achieved.

Further, at least one of the shrinkage ratio of the electrode material (containing the electrode material filled in the via-hole) constituting the coil pattern formed on the magnetic green sheet in the heat treatment step (sintering process), and the shrinkage ratio of the magnetic material layer arranged so as to surround the coil pattern (the electrode material) in the heat treatment step (sintering process) is controlled. Therefore, the sum of the thickness of the electrode material in the via-hole and the thickness of the coil pattern after the sintering is greater than the thickness of the magnetic materials deriving from the magnetic green sheet and the magnetic material layer after the sintering. The respective coil patterns are securely connected through the via-hole. A lamination-type coil component having very low direct current resistance, excellent stability, and very high reliability is achieved.

The present invention can be applied to methods of producing components provided with different types of lamination-type coils. By utilizing the present invention as a method of producing an inductor, a lamination-type inductor having a high reliability is efficiently produced.

In the lamination type coil component according to the second preferred embodiment of the present invention, the sum of the thickness of the electrode material in the via-hole and the thickness of the coil conductor is controlled to be greater than the sum of the sintered magnetic layer and the sintered magnetic material layer. Therefore, the respective coil conductors are securely connected to each other. A lamination-type coil component having a high reliability is obtained.

The lamination-type coil component can be efficiently produced by any one of the above-described methods of producing a lamination-type coil component.

The present invention can be applied to components provided with a variety of lamination-type coils. By applying the preferred embodiments of the present invention to an inductor, a lamination-type inductor having a high reliability is obtained.

The lamination-type inductor can be efficiently produced according the method of producing a lamination type coil component according to preferred embodiments of the present invention.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A method of producing a lamination-type coil component comprising the steps of:

applying an electrode material for formation of a coil to a magnetic green sheet having a via-hole provided therein into a desired pattern, wherein a coil pattern is formed with the electrode material being filled into the via-hole;

forming a magnetic material layer having a thickness which is less than a thickness of the coil pattern such that the magnetic material layer surrounds the coil pattern;

laminating a plurality of the magnetic green sheets each having the coil pattern and the magnetic material layer, wherein a laminate is formed, the laminate having a coil defined by said coil patterns formed on said plurality of magnetic green sheets formed therein;

press-bonding the laminate, and heat-treating the press-bonded laminate to form a sintered body.

2. A method of producing a lamination-type coil component according to claim 1, further comprising the step of controlling at least one of the thickness of the coil pattern and the thickness of the magnetic material layer formed on each magnetic green sheet, and thickness-reduction ratios of the coil pattern and the magnetic material layer in the press-bonding step, wherein the sum of a thickness of the electrode material in the via-hole and the thickness of the coil pattern is greater than the sum of a thickness of the magnetic green sheet and the thickness of the magnetic material layer after the press-bonding step.

3. A method of producing a lamination-type coil component according to claim 1, further comprising the step of controlling at least one of a shrinkage ratio of the coil pattern formed on the magnetic green sheet in the heat treatment step, and a shrinkage ratio of the magnetic material layer surrounding the coil pattern in the heat treatment step, wherein the sum of a thickness of electrode material in the via-hole and the thickness of the coil pattern after sintering is greater than the sum of a thickness of the magnetic green sheet and the thickness of the magnetic material layer after the sintering.

4. A method of producing a lamination-type coil component according to claim 1, wherein the lamination-type coil component is an inductor.

5. A method of producing a lamination-type coil component according to claim 1, further including the step of forming the green sheet by mixing a ratio of approximately 48 mol % of $Fe_2O_3$, 28 mol % of ZnO, 16 mol % of NiO, and 8 mol % of CuO to produce a powder, calcining the powder at approximately 750° C. for 1 hour, wet-crushing the calcined powder for approximately 30 minutes with an attritor, adding a binder resin and mixing for approximately 1 hour to obtain a slurry, and spreading the slurry with a doctor blade into a green sheet with a film thickness of approximately 80$\mu$m or less, wherein the step of forming the green sheet is performed before the step of applying the electrode material.

6. A method of producing a lamination-type component according to claim 1, wherein the electrode material is applied to a thickness of approximately 24 $\mu$m.

7. A method of producing a lamination-type component according to claim 1, wherein the magnetic material layer is formed to a thickness of approximately 18 $\mu$m.

8. A method of producing a lamination-type component according to claim 1, wherein the press-bonding step is conducted at a temperature of approximately 40° C. and a pressure of approximately 1.21 t/cm$^2$ to form a press-bonded laminate.

9. A method of producing a lamination-type component according to claim 1, the step of heat-treating the press-bonded laminate is conducted at approximately 500° C.

10. A method of producing a lamination-type component according to claim 1, further comprising the steps of applying an electrode paste to ends of the sintered body, drying the electrode paste at approximately 150° C. for approximately 15 minutes, baking the sintered body to produce a pair of external electrodes.

* * * * *